US005595011A

United States Patent [19]

Gorslin

[11] Patent Number: 5,595,011

[45] Date of Patent: Jan. 21, 1997

[54] TELESCOPIC-SIGHT SYSTEM FOR AK47-TYPE RIFLES

[76] Inventor: Richard A. Gorslin, 707 E. Piute Ave., Phoenix, Ariz. 85024

[21] Appl. No.: 552,939

[22] Filed: Nov. 3, 1995

[51] Int. Cl.[6] ..... F41G 1/38

[52] U.S. Cl. ..... 42/101; 42/100

[58] Field of Search ..... 42/101, 100; 33/245; 362/110

[56] References Cited

U.S. PATENT DOCUMENTS

| | | | |
|---|---|---|---|
| 4,299,044 | 11/1981 | Johannsen | 42/1 ST |
| 4,430,822 | 2/1984 | Fromming et al. | 42/71 R |
| 4,756,111 | 7/1988 | Lapier | 42/101 |
| 5,070,636 | 12/1991 | Mueller | 42/94 |
| 5,189,560 | 2/1993 | Edwards et al. | 359/744 |
| 5,428,915 | 7/1995 | King | 42/101 |

*Primary Examiner*—Charles T. Jordan
*Assistant Examiner*—Meena Chelliah
*Attorney, Agent, or Firm*—Martin L. Stoneman

[57] ABSTRACT

This invention provides an improved telescopic sight system for rifles, particularly by providing for AK47-type rifles an improved telescopic sight system utilizing a pistol-type telescopic sight and a mounting method which does not require disassembly of the rifle for mounting or for cleaning and which provides maximum stability and rigidity. The pistol-type telescopic sight is mounted above the normal front gunsight and its mounting there does not interfere with "fast" normal-size sighting of a target.

20 Claims, 3 Drawing Sheets

FIG. 1
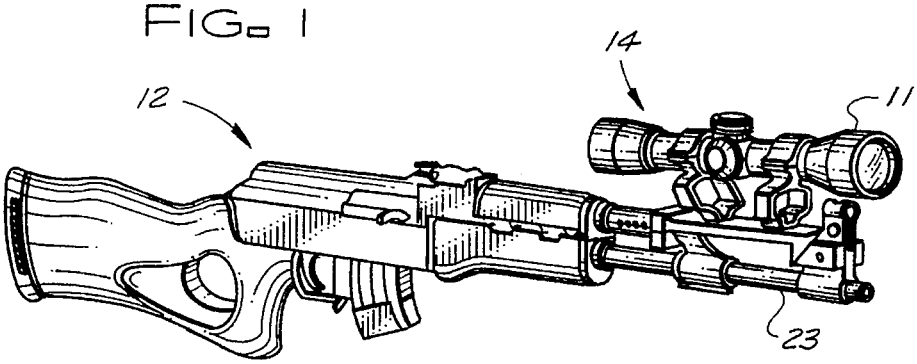
FIG. 2
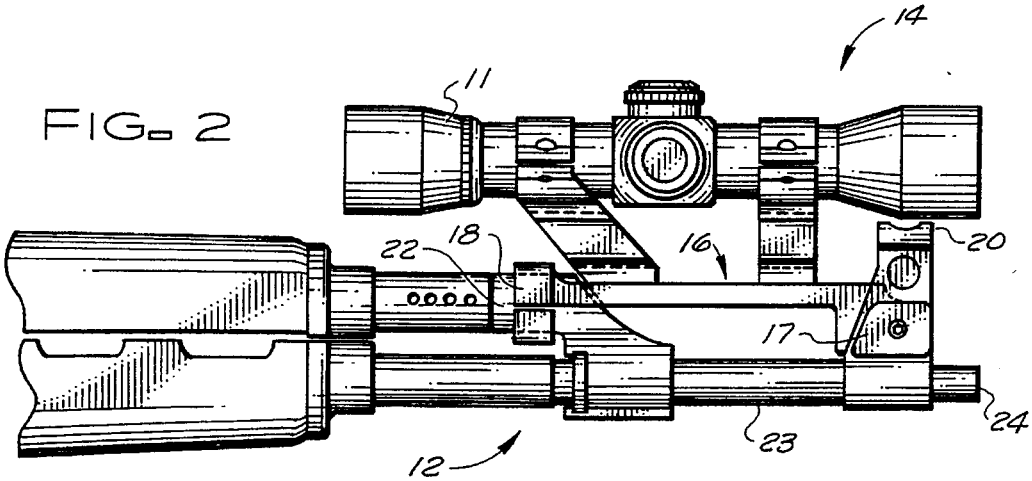
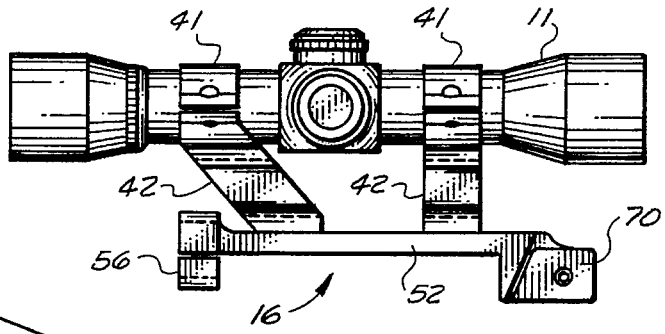
FIG. 3
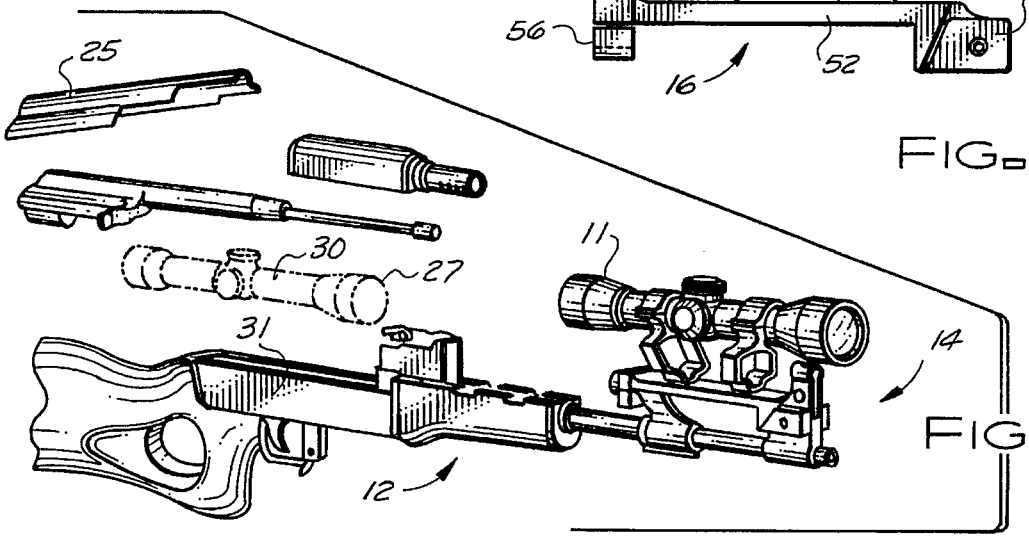
FIG. 4

FIG. 8
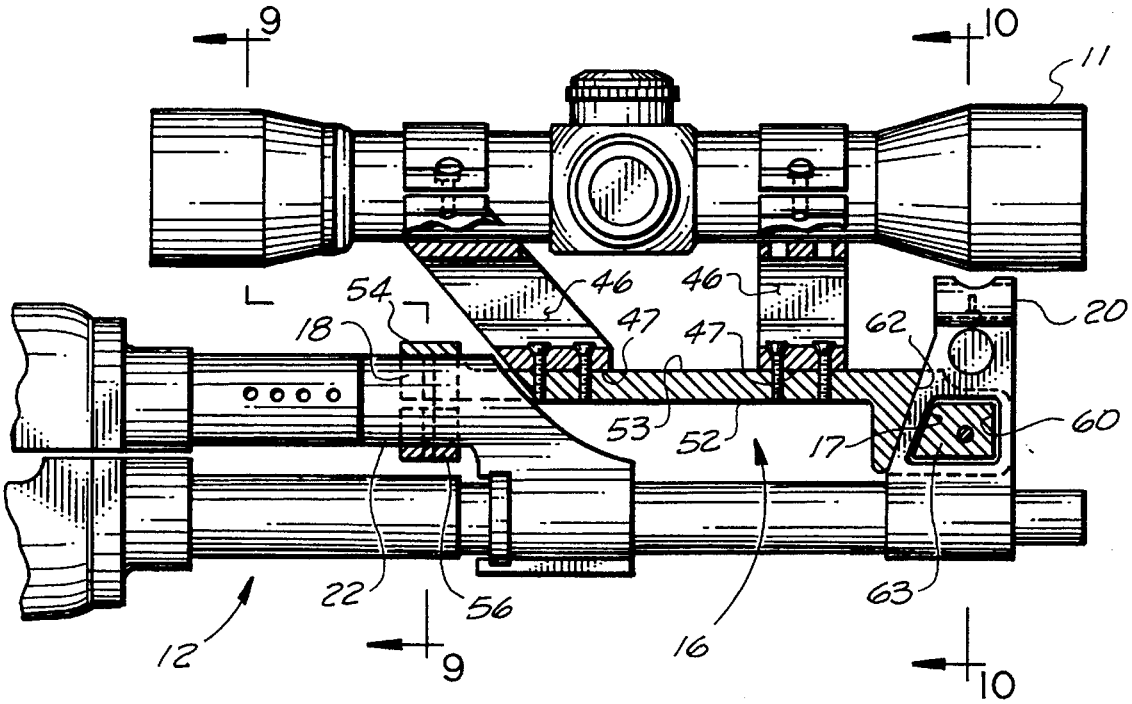
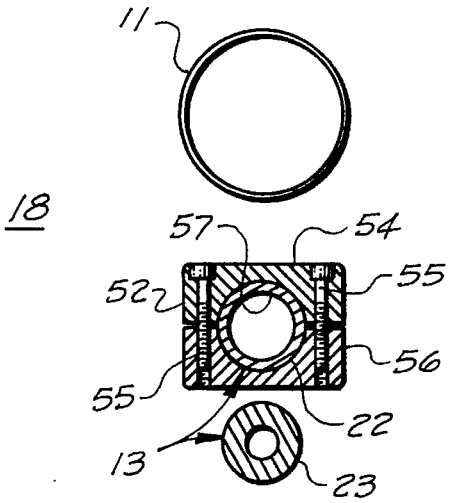
FIG. 9
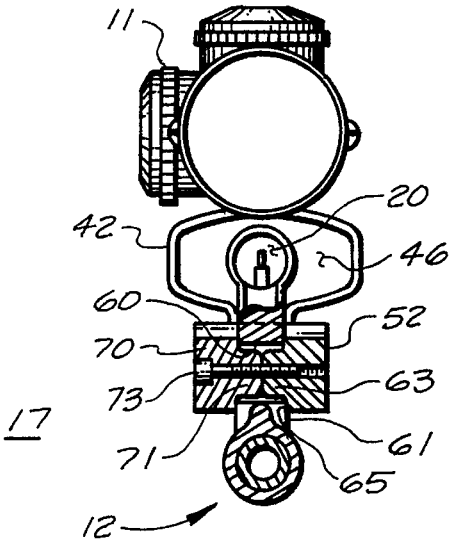
FIG. 10

TELESCOPIC-SIGHT SYSTEM FOR AK47-TYPE RIFLES

BACKGROUND OF THE INVENTION

1. Field of the Invention

This invention relates to providing an improved telescopic sight system for rifles. More particularly, this invention concerns providing for AK47-type rifles an improved telescopic sight system utilizing a pistol-type telescopic sight.

2. Description of the Prior Art

In the prior art, when doing partial disassemblies for cleaning of rifles, particularly of the AK47 type, it is necessary to remove any rifle telescopic sight that is in the way; and prior-art telescopic sights for such rifles have been mounted above the trigger area, where they are most definitely in the way and must be removed for cleaning the rifle. Furthermore, after cleaning the rifle, such rifle telescopic sights of the prior art must be re-mounted and re-adjusted prior to use; and present mounting locations and methods do not usually give the required amount of stability and rigidity, or they depend for such stability on attachment to the barrel, which is usually unwise.

Furthermore, in using such rifle telescopic sights of the prior art, "fast" normal-size sighting of a target (before using the enlarged telescopic image to "zero in") is made difficult because mounting of the rifle telescopic sight interferes with the normal view down the barrel through the normal sights of the rifle and because there is a large focal difference between the two views. And some prior art rifle telescopic sights even require modification (as well as disassembly) of the rifle before installation.

Among the needs not met in the prior art are (1) the need to have an enlarged-view sight available without interfering with a user's ability to quickly sight a normal-size target along the barrel; (2) the need to have an enlarged-view sight available which does not interfere with cleaning of the rifle; (3) the need to have an enlarged-view sight available which does not have to be removed, replaced, and re-adjusted each time the rifle is cleaned; (4) the need to mount an enlarged-view sight onto a rifle without disassembly or modification of the rifle; (5) the need to mount an enlarged-view sight with the maximum degree of stability and rigidity, but without direct attachment to the barrel; and (6) the need to fulfill all these mentioned needs in a manner which is efficient and inexpensive.

OBJECTS OF THE INVENTION

A primary object of the present invention is to fulfill the above-mentioned needs by the provision of an improved telescopic-sight system for rifles, particularly of the AK47 type. A further primary object of the present invention is to provide such an improved telescopic-sight system for rifles which is efficient and inexpensive. In addition, it is a primary object of this invention to provide such telescopic-sight systems which overcome the flaws in such sights of the prior art. Other objects of this invention will become apparent with reference to the following invention descriptions.

SUMMARY OF THE INVENTION

According to a highly-preferred embodiment of the present invention, this invention provides an improvement in telescopic sights for rifle means of the type comprising barrel means portions located at about arm's length from the eyes of an aiming user, comprising, in combination: pistol-type telescopic sight means for enlarged focused viewing of a target when such pistol-type telescopic sight means is located about an arm's length from such eyes of a such aiming user; and mounting means for mounting such pistol-type telescopic sight means along and above such barrel means portions. Further, this invention provides such improvement wherein: such rifle means comprises front-barrel-portion-mounted front gunsight means; and such mounting means comprises attachment means for attaching such pistol-type telescopic sight means to such front gunsight means. Even further, it provides such improvement wherein: such rifle means comprises gas release port means; and such mounting means comprises second attachment means for attaching such pistol-type telescopic sight means to such gas release port means.

Additionally, according to such preferred embodiment, the present invention provides such improvement wherein such rifle means comprises an AK47-type rifle having front-barrel-portion-mounted front gunsight means and mid-barrel-portion-mounted gas release port means and wherein such mounting means comprises: front attachment means for attaching such mounting means to such front gunsight means; and rear attachment means for attaching such mounting means to such gas release port means. Further, this invention provides such improvement wherein such aiming user's view of such front gunsight means is unobstructed by such pistol-type telescopic sight means and such mounting means; and, further, wherein such mounting means comprises adjustment means for adjusting the position of such pistol-type telescopic sight means for improved aiming; and, further, wherein such pistol-type telescopic sight means is mounted to maintain a position above such front gunsight means; and, further, wherein such mounting means comprises riser means for holding such pistol-type telescopic sight means above such front gunsight means without obstructing such aiming user's line of sight to such front gunsight means.

Also, according to such preferred embodiment, the present invention provides such improvement wherein such mounting means comprises: frame member means attached along and above such barrel means portions, a front portion of such frame member means being attached to such front gunsight means, and a rear portion of such frame member means being attached to such gas release port means; riser means attached to such frame member means along and above such frame member means, such riser means being constructed and arranged so as not to obstruct such aiming user's line of sight to such front gunsight means, and such riser means being constructed and arranged for attachment of such pistol-type telescopic sight means; said mounting means being constructed and arranged for mounting of said pistol-type telescopic sight means on said AK47-type rifle without modification or disassembly of said AK47-type rifle.

Yet additionally, according to a preferred embodiment thereof, this invention provides a method of making an improved telescopic sight on rifle means of the type comprising barrel means portions located at about arm's length from the eyes of an aiming user, comprising the steps of: providing pistol-type telescopic sight means for enlarged focused viewing of a target when such pistol-type telescopic sight means is located about an arm's length from such eyes of a such aiming user; and mounting such pistol-type telescopic sight means along and above such barrel means portions. Further, this invention provides such method wherein such rifle means comprises front-barrel-portion-mounted front gunsight means and such method further comprises the step of attaching such pistol-type telescopic sight means to such front gunsight means. Even further, this invention provides such method wherein such mounting of such pistol-type telescopic sight means along and above such barrel means portions is accomplished so as not to obstruct the line of sight of such aiming user to such front gunsight means, and, further, wherein such rifle means comprises gas release port means and such method further comprises the step of attaching such pistol-type telescopic sight means to such gas release port means.

Yet further, according to a preferred embodiment, this invention provides a method of making an improved telescopic sight on an AK47-type rifle comprising a barrel, a front-barrel-portion-mounted front gunsight, and a mid-barrel-portion-mounted gas release port, comprising the steps of: providing a pistol-type telescopic sight; mounting such pistol-type telescopic sight along and above such barrel, such mounting comprising attaching a frame member along and above such barrel, comprising the steps of attaching a front portion of such frame member to such front gunsight and attaching a rear portion of such frame member to such gas release port. Further, this invention provides such method wherein such mounting steps require no modification or disassembly of said AK47-type rifle and place no constriction on such barrel.

Even more, this invention provides such method wherein such mounting comprises the further steps of: attaching to such frame member riser means above and along such frame member; and attaching such pistol-type telescopic sight to such riser means. Further, this invention provides such method further comprising the step of adjusting the position of such pistol-type telescopic sight for improved aiming. Even further, this invention provides such method wherein such riser means is constructed, arranged, and attached so as not to obstruct such aiming user's line of sight to such front gunsight; and, further, wherein such riser means is constructed, arranged, and attached so as to hold such pistol-type telescopic sight means above such front gunsight.

BRIEF DESCRIPTION OF THE DRAWINGS

FIG. 1 is a perspective view illustrating an AK47-type rifle having attached thereon the preferred embodiment of the telescopic sight means and mounting of the present invention.

FIG. 2 is a side view of the forward end of the rifle and telescopic sight means of FIG. 1.

FIG. 3 is a side view of the telescopic sight means and mounting apart from the rifle.

FIG. 4 is a perspective view of the preferred embodiment of FIG. 1 showing, partially exploded, the prior art location of a rifle telescopic sight.

FIG. 8 is a side view with partial cross-section showing mounting details.

FIG. 9 is a cross-sectional view, through the section 9—9 of FIG. 8, of the rear mounting of the telescopic sight means.

FIG. 10 is a cross-sectional view, through the section 10—10 of FIG. 8, of the front mounting of the telescopic sight means.

DETAILED DESCRIPTION OF A PREFERRED EMBODIMENT AND THE BEST MODE OF PRACTICE

Figure 5:
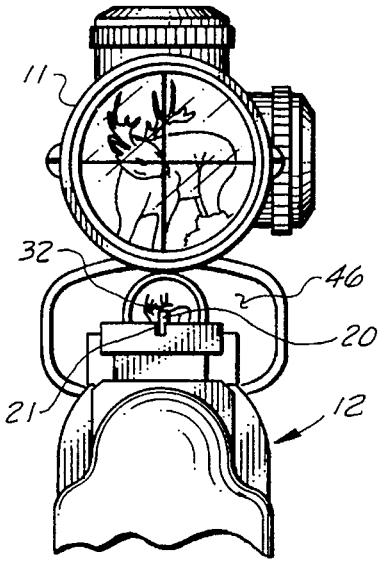
FIG. 5 is a partial rear view through the telescopic sight means of the preferred embodiment.

FIG. 1 illustrates a rifle means, embodied by rifle 12, particularly an AK47-type rifle, to which a pistol-type telescopic sight means (for enlarged focused viewing of a target when such pistol-type telescopic sight means is located about an arm's length from the eyes of an aiming user), embodied by telescopic sight 11, has been attached in a forward location 14 (at about such arm's length) above and along barrel means portions at such location 14 of the barrel means, embodied by the rifle barrel 23. The telescopic sight 11 is of the type commonly referred to as a telescopic pistol sight. This type of telescopic sight incorporates an optical lens system which allows a clear field of enlarged viewing while located a lengthy distance (as mentioned, about an arm's length) from the user's eye. The common usage of this type of telescopic sight would be at outstretched arm's distance while mounted atop a hand-held pistol. This type of telescopic sight 11 mounted on a rifle 12 in such forward location 14 provides numerous advantages over conventional sighting systems as will be described later in detail. Advantages include improved locating and sighting of target, and sighting speed. The forward telescopic sight location obviously leaves the remainder of the rifle uncluttered and accessible for normal operation and maintenance.

In FIG. 2 the actual mounting of the telescopic sight 11 in the forward location 14 of the rifle 12 is illustrated. The telescopic sight 11 is located in a position above the normal front-barrel-portion-mounted front gunsight means of rifle 12, embodied by such rifle's front normal sight 20, and above the rifle's mid-barrel-portion-mounted gas release port means, embodied by the gas release port 22. Telescopic sight 11 is attached to rifle 12 by the mounting means of the present invention, embodied by mounting bracketry system 16 comprised of specialized clamps and adapters to be hereinafter described. But it is now noted that clamping at the front attachment location 17 and the rear attachment location 18 assure maximum rigidity and stability which are often compromised with conventional rifle telescopic-sight installations, as will be addressed further. The forward end of telescopic sight 11 is generally located in line with the front end 24 of rifle barrel 23.

FIG. 3 illustrates the telescopic sight 11 with its mounting bracketry system 16 (not attached to the rifle 12). Components of mounting bracketry system 16 include frame member means embodied by frame member 52 and riser means embodied by clamp risers 42 and upper clamp halves 41. Frame member 52 is attached by lower clamp half 56 to gas release port 22 and by front clamp plate 70 for attachment to the pedestal of front normal sight 20. A prime feature of the mounting means of the present invention is that no modifications or alterations to the rifle 12 are required.

As illustrated in FIG. 4 with the telescopic sight 11 attached to the forward location 14 of the (AK47-type) rifle 12 the remainder of the rifle is unobstructed. In particular, the area of the rifle 12 requiring periodic maintenance and disassembly for routine cleaning has not been altered or obstructed. A conventional rifle telescopic sight 27 is shown with broken lines in the conventional sight mounting location 30. This conventional location hinders accessibility and may even require sight removal for routine maintenance. In addition to the task and time required to remove and replace the sight and/or it's mounts, the sight may require readjustment to achieve its former settings. In addition, the portion or components of the rifle 12 to which the conventional sight 27 is attached commonly provide unsuitable conditions. The dust cover 25, shown removed for normal accessibility, is of flimsy sheet metal construction and offers an unstable sight mounting. The portion of the rifle above the trigger area 31, although not requiring removal for normal maintenance, is difficult to adapt to and requires machining for sight mount attachment.

FIG. 5 illustrates the view looking forward while sighting on a target with the telescopic sight 11 mounted on rifle 12. With the telescopic sight 11 elevated above front normal sight 20, as in the present invention, the sighting characteristics using the rear normal sight 21 and the front normal sight 20 remain unchanged. While locating on a target 32 with the normal sights of the rifle, the aimer/shooter slightly raise an eye-view to view the target 32 enlarged through the telescopic sight 11 and adjusts the aim as necessary. With the telescopic sight 11 being of the type used for pistol shooting, the aimer/shooter need not change the eye focus distance while alternately viewing through the normal sights 20 and 21—and the telescopic sight 11. This ease and convenience of viewing provides increased sighting speed, i.e., the pistol-type telescopic sight of this invention is mounted above the normal front gunsight and its mounting there does not interfere with "fast" normal-size sighting of a target. Ease of viewing is also appreciated by shooters who use prescription eyeglasses and have difficulty with varying focal distances.

Figure 6:
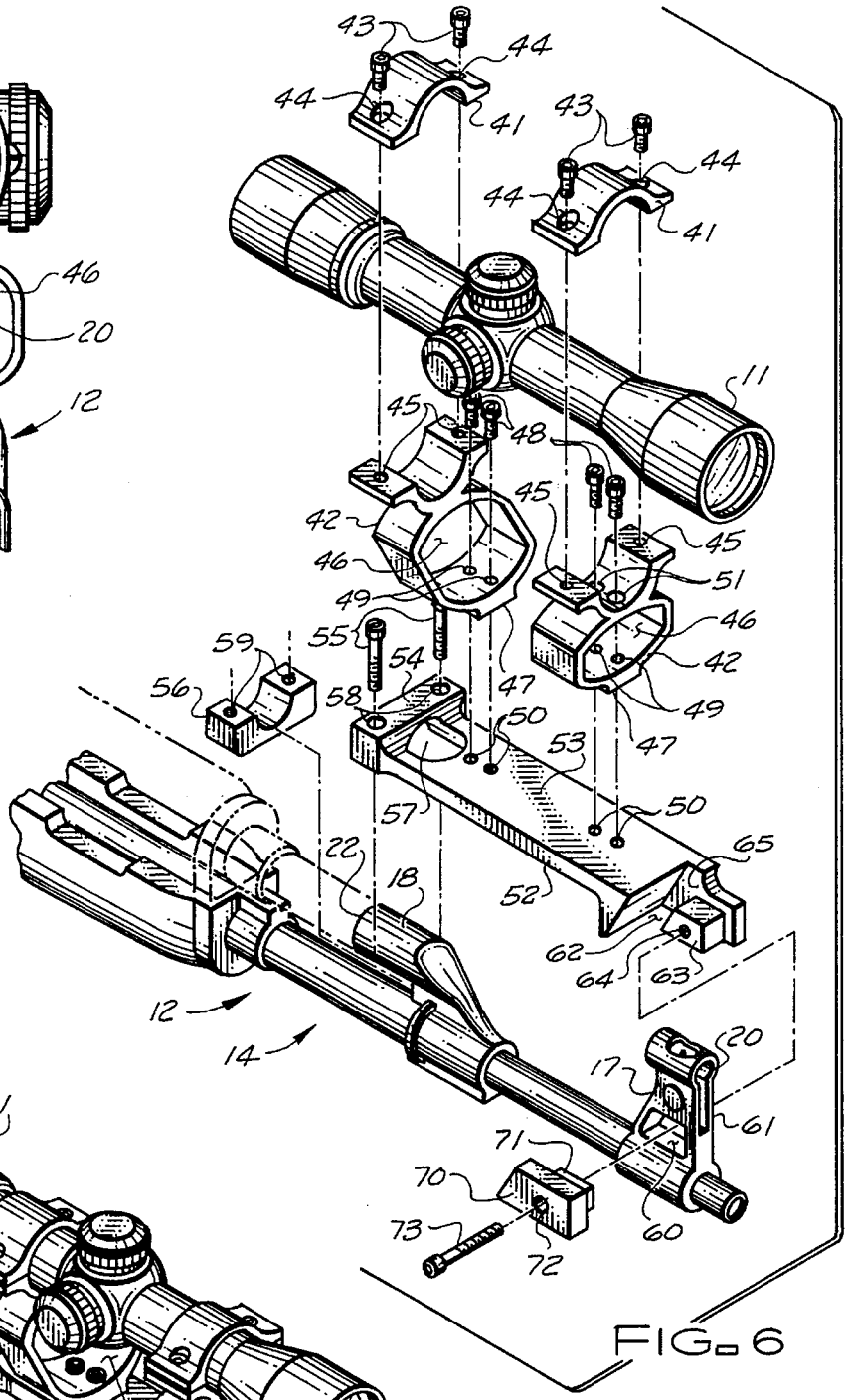
FIG. 6 is an exploded perspective view of the telescopic sight means, mounting means, and forward end of the rifle, showing in detail a preferred method of attachment to the rifle.

In FIG. 6 are shown in perspective detail the components of the mounting bracketry system 16 and the location 14 of rifle 12 (AK47-type) where telescopic sight 11 is attached. Basically, the frame member 52 is attached to the rifle in the location 14 and the telescopic sight 11 is mounted, through the riser means of the present invention, to frame member 52. Two clamp risers 42 support telescopic sight 11 in a stable manner the correct distance above the normal sight view. Each clamp riser 42 incorporates a large view opening 46 so as not to obstruct the normal sight view. The top portion of each clamp riser 42 is a radiused half shell (as shown) to cradle and locate the telescopic sight 11. The telescopic sight 11 is secured with two upper clamp halves 41 and four screws 43 passing through screw holes 44 and tightening into threaded holes 45 of clamp risers 42. If temporary removal of telescopic sight 11 is required at a later time, it should be accomplished at this just-described attachment point between the upper clamp halves 41 and clamp risers 42 to eliminate need for re-adjustment. It is noted that in the initial installation of the pistol-type telescopic sight system to the rifle, the just-described attachment occurs as the last step.

Further describing the mounting, the frame member 52 is designed to interface with the rifle 12 at the front attachment location 17, which is the vertical pedestal for the front normal sight 20, and at the rear attachment location 18, which is a portion of the gas release port 22. At the rear of the frame member 52 is a rear upper clamp portion 54 with a locating radius 57 indented on the bottom surface to locate (as shown) on the round gas release port 22 of rifle 12. A lower clamp half 56 fits to the underside of the round gas release port 22 and secures the frame member 52 using two screws 55 passing through screw holes 58 into threaded holes 59. Note (see FIG. 6) that a portion of the rifle's gas porting may be removed to facilitate placement of the lower clamp half 56. The front attachment of frame member 52 is accomplished by clamping its interface surface 65 to the left face 61 and through the opening 60 of the vertical portion of the normal front sight 20. The frame member 52 has a clearanced area 62 to fit around the normal front sight 20 and a locating lug 63 to fit partially into opening 60. To secure this attachment point is a front clamp plate 70 with a protruding boss 71 which screws to the frame member 52 with screw 73 passing through screw hole 72 into the threaded hole 64 of the locating lug 63. The bottom surface 47 of the clamp risers 42 are then attached to the top surface 53 of frame member 52 utilizing screws 48 passing through screw holes 49 into threaded holes 50. To facilitate assembly, the clamp risers 42 incorporate access holes 51 through which a hex allen wrench can be inserted. After the frame member 52 and clamp risers 42 are attached, the telescopic sight 11 can be installed as previously described.

Figure 7:
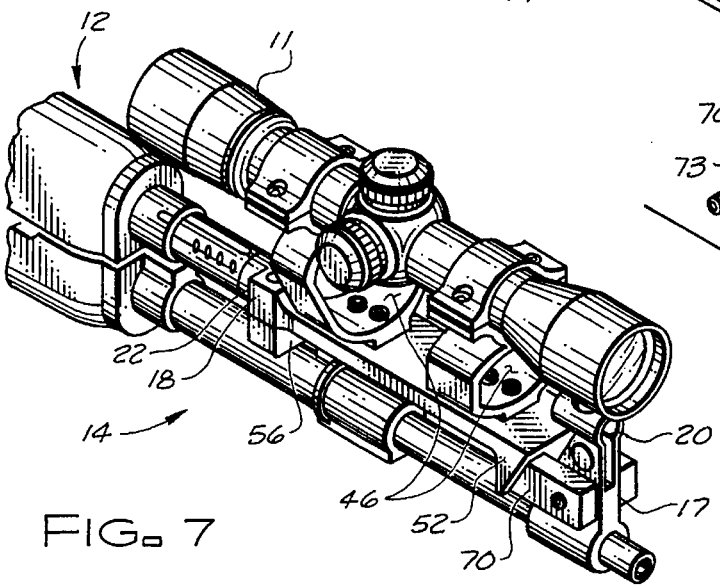
FIG. 7 is a close-up perspective view of the telescopic sight means mounted on the forward end of the rifle.

FIG. 7 shows the telescopic sight 11 installed in a forward location 14 on (AK47-type) rifle 12. As mentioned, the installation includes view openings 46 to provide a line of sight to the front normal sight 20. Also, as mentioned, the frame member 52 is attached to the rifle's gas release port 22 at the rear attachment location 18 with a lower clamp half 56 and to the vertical pedestal of the front normal sight 20 with the front clamp plate 70 at the front attachment location 17.

In FIG. 8 is shown the telescopic sight 11 installed on the rifle 12 with the mounting bracketry system 16 illustrated in partial cross section to clarify attachment points. Shown is the frame member 52 secured at the rear attachment location 18 on the gas release port 22 with rear upper clamp portion 54 and lower clamp half 56 and secured at the front attachment location 17 through opening 60 of the vertical pedestal for the front normal sight 20 with locating lug 63. The clearanced area 62 of the frame member 52 is shown fitting around the irregular form of the pedestal of front normal sight 20. Also shown are the attachment points between the bottom surfaces 47 of the clamp risers 42 and the top surface 53 of the frame member 52. Also shown in cross section are the view openings 46 in line with the front normal sight 20.

FIG. 9 shows in illustrative form a perpendicular cross section (through the section 9—9 of FIG. 8) at the rear attachment location 18. Items shown are the telescopic sight 11 directly in a vertical line above the rifle 12, the rifle barrel 23 and the gas release port 22. The rear upper clamp portion 54 of the frame member 52 with its locating radius 57 registering on the gas release port 22 is held in place with the lower clamp half 56 and secured with two screws 55.

FIG. 10 is a front view of such rifle 12 in cross section (through the section 10—10 of FIG. 8) at the front attachment location 17. Shown are the spacial relationships between the telescopic sight 11, the front normal sight 20, and the clamp risers 42 with view openings 46. Shown also, with respect to the front attachment location 17, is the opening 60 and the left face 61 of the vertical pedestal for front normal sight 20. Mating to these features of the rifle 12 are the locating lug 63 and interface surface 65 of frame member 52. This interface is held securely by the front clamp plate 70, located by its protruding boss 71 and secured with screw 73.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. An improvement in telescopic sights for rifle means of the type comprising barrel means portions located at about arm's length from the eyes of an aiming user, comprising, in combination:

a. pistol-type telescopic sight means for enlarged focused viewing of a target when said pistol-type telescopic sight means is located about an arm's length from said eyes of a said aiming user; and b. mounting means for mounting said pistol-type telescopic sight means along and above said barrel means portions.

2. The improvement according to claim 1 wherein:

a. said rifle means comprises front-barrel-portion-mounted front gunsight means; and b. said mounting means comprises attachment means for attaching said pistol-type telescopic sight means to said front gunsight means.

3. The improvement according to claim 2 wherein:

a. said rifle means comprises gas release port means; and b. said mounting means comprises second attachment means for attaching said pistol-type telescopic sight means to said gas release port means.

4. The improvement according to claim 1 wherein:

a. said rifle means comprises gas release port means; and b. said mounting means comprises attachment means for attaching said pistol-type telescopic sight means to said gas release port means.

5. The improvement according to claim 1 wherein said rifle means comprises an AK47-type rifle having front-barrel-portion-mounted front gunsight means and mid-barrel-portion-mounted gas release port means and wherein said mounting means comprises a. front attachment means for attaching said mounting means to said front gunsight means; and b. rear attachment means for attaching said mounting means to said gas release port means.

6. The improvement according to claim 5 wherein said aiming user's view of said front gunsight means is unobstructed by said pistol-type telescopic sight means and said mounting means.

7. The improvement according to claim 5 wherein said mounting means comprises adjustment means for adjusting the position of said pistol-type telescopic sight means for improved aiming.

8. The improvement according to claim 5 wherein said pistol-type telescopic sight means is mounted to maintain a position above said front gunsight means.

9. The improvement according to claim 8 wherein said mounting means comprises riser means for holding said pistol-type telescopic sight means above said front gunsight means without obstructing said aiming user's line of sight to said front gunsight means.

10. The improvement according to claim 9 wherein said mounting means comprises:

a. frame member means attached along and above said barrel means portions, a front portion of said frame member means being attached to said front gunsight means, and a rear portion of said frame member means being attached to said gas release port means; and b. riser means attached to said frame member means along and above said frame member means, i. said riser means being constructed and arranged so as not to obstruct said aiming user's line of sight to said front gunsight means; and ii. said riser means being constructed and arranged for attachment of said pistol-type telescopic sight means;

c. said mounting means being constructed and arranged for mounting of said pistol-type telescopic sight means on said AK47-type rifle without modification or disassembly of said AK47-type rifle.

11. A method of making an improved telescopic sight on rifle means of the type comprising barrel means portions located at about arm's length from the eyes of an aiming user, comprising the steps of:

a. providing pistol-type telescopic sight means for enlarged focused viewing of a target when said pistol-type telescopic sight means is located about an arm's length from said eyes of a said aiming user; and b. mounting said pistol-type telescopic sight means along and above said barrel means portions.

12. The method according to claim 11 wherein said rifle means comprises front-barrel-portion-mounted front gunsight means and said method further comprises the step of a. attaching said pistol-type telescopic sight means to said front gunsight means.

13. The method according to claim 12 wherein said mounting of said pistol-type telescopic sight means along and above said barrel means portions is accomplished so as not to obstruct the line of sight of said aiming user to said front gunsight means.

14. The method according to claim 11 wherein said rifle means comprises gas release port means and said method further comprises the step of a. attaching said pistol-type telescopic sight means to said gas release port means.

15. A method of making an improved telescopic sight on an AK47-type rifle comprising a barrel, a front-barrel-portion-mounted front gunsight, and a mid-barrel-portion-mounted gas release port, comprising the steps of:

a. providing a pistol-type telescopic sight;

b. mounting said pistol-type telescopic sight along and above said barrel, said mounting comprising attaching a frame member along and above said barrel, comprising the steps of:

i. attaching a front portion of said frame member to said front gunsight and ii. attaching a rear portion of said frame member to said gas release port.

16. The method of claim 15 wherein said mounting steps require no modification or disassembly of said AK47-type rifle and place no constriction on said barrel.

17. The method of claim 15 wherein said mounting comprises the further steps of:

a. attaching to said frame member riser means above and along said frame member; and b. attaching said pistol-type telescopic sight to said riser means.

18. The method according to claim 17, further comprising the step of adjusting the position of said pistol-type telescopic sight for improved aiming.

19. The method of claim 17 wherein said riser means is constructed, arranged, and attached so as not to obstruct said aiming user's line of sight to said front gunsight.

20. The method of claim 19 wherein said riser means is constructed, arranged, and attached so as to hold said pistol-type telescopic sight means above said front gunsight.

* * * * *